United States Patent [19]

Wadden

[11] 4,279,674

[45] Jul. 21, 1981

[54] PROCESS FOR PREPARING WORKS OF ART

[76] Inventor: Marie-Claire Wadden, 10505 Weymouth Ave., Beltsville, Md. 20705

[21] Appl. No.: 107,565

[22] Filed: Dec. 27, 1979

[51] Int. Cl.[3] ..... B05D 5/06; B05D 1/38

[52] U.S. Cl. ..... 156/62; 427/260; 427/264; 427/265; 427/270; 434/84

[58] Field of Search ..... 427/260, 262, 264, 267, 427/270, 277, 265, 11, 443, 442, 434.3; 35/26; 118/202; 219/228, 229; 156/62

[56] References Cited

U.S. PATENT DOCUMENTS

| | | | |
|---|---|---|---|
| 119,291 | 9/1871 | Wolfson | 427/277 |
| 1,219,903 | 3/1917 | Andrews | 219/228 |
| 3,840,113 | 10/1974 | Bartleson | 35/26 X |
| 4,125,655 | 11/1978 | Kanzelberger | 427/270 X |

FOREIGN PATENT DOCUMENTS

| | | | |
|---|---|---|---|
| 2706 | of 1877 | United Kingdom | 427/262 |
| 457583 | 12/1936 | United Kingdom | 427/264 |

OTHER PUBLICATIONS

*Milton Bradley Arts & Activities 1965,* Milton Bradley Company, Springfield, Mass., 1965, p. 11.

*Primary Examiner*—Evan K. Lawrence

*Attorney, Agent, or Firm*—Shoemaker and Mattare, Ltd.

[57] ABSTRACT

A process for preparing a work of art includes steps of melting crayon, transferring that molten crayon to a backing member to form a background and forming a design on that background. The design is formed using a hand-held heating element to melt portions of the background and/or to transfer further molten crayon to the background. A kit containing crayons and backing members is also disclosed.

12 Claims, 10 Drawing Figures

PROCESS FOR PREPARING WORKS OF ART

BACKGROUND OF THE INVENTION

The present invention relates in general to ornamentation, and, more particularly, to a method of preparing works of art using wax.

There are a variety of methods for preparing original works of art, many of which have been the subjects of patents. Examples of such methods are disclosed in U.S. Pat. Nos. 1,815,589, 2,065,266, 2,811,800, 3,772,421 and 3,799,819.

Presented herein is a unique art form wherein the "paint" is wax and the "brush" is a hand-held tool which is warmed sufficiently to melt wax.

SUMMARY OF THE INVENTION

The method embodying the teachings of the present invention uses colored wax, such as crayons, or the like, to provide the "paint", and a hot hand-held tool, such as a travel iron, or the like, to "brush" the "paint" for developing a picture, design or the like.

The colored wax is first melted, then is transferred to a paper member to define a background. A hand-held tool is maintained at a temperature sufficient to melt the colored wax, and is used to define lines or other patterns in the background or to place other colors onto that background. The transfer of colored wax using the hand-held tool is accomplished by effecting contact between the hot tool and a crayon, or the like, to transfer colored wax to an appropriate location on the tool. The wax from the tool is then transferred to the background.

A finished picture is buffed, then a protective coat of varnish or other such material is placed on that picture.

OBJECTS OF THE INVENTION

A main object of the present invention is to provide a unique art form.

Another object of the present invention is to provide a new method for producing original works of art.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Shown in FIGS. 1–6, and FIGS. 8 and 9, are steps comprising a method of forming an original work of art. These steps embody the teachings of the present invention; however, certain variations can be effected without departing from the scope of this invention. Such steps, even though not specifically identified herein, are intended to be included.

Figure 1:
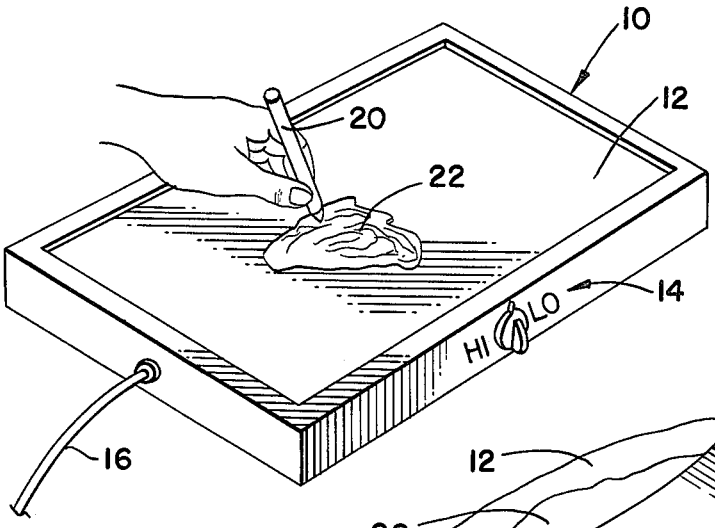
FIG. 1 is a perspective view showing one step in carrying out the process embodying the teachings of the present invention.
Figure 2:
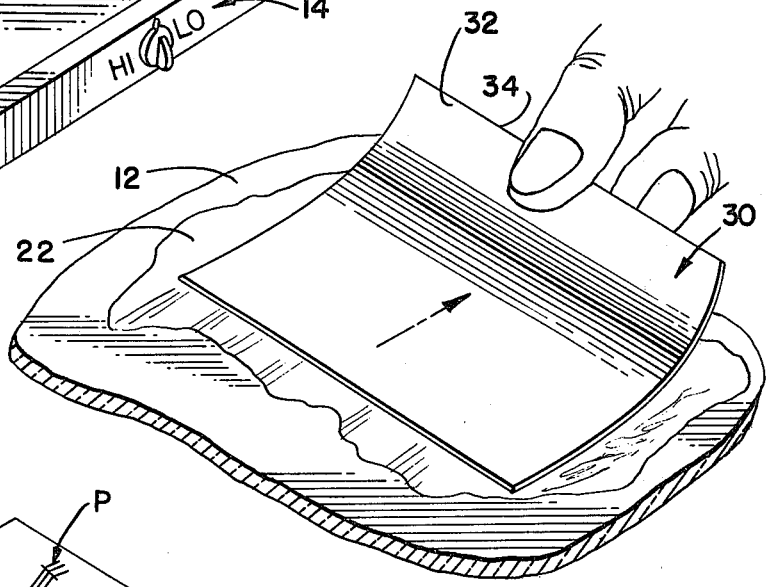
FIG. 2 is a perspective view showing another step in carrying out the process embodying the teachings of the present invention.
Figure 5:
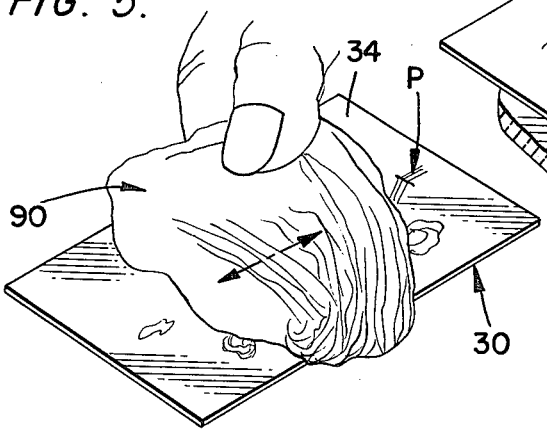
FIG. 5 is a perspective view of another step in carrying out the process embodying the teachings of the present invention.
Figure 6:
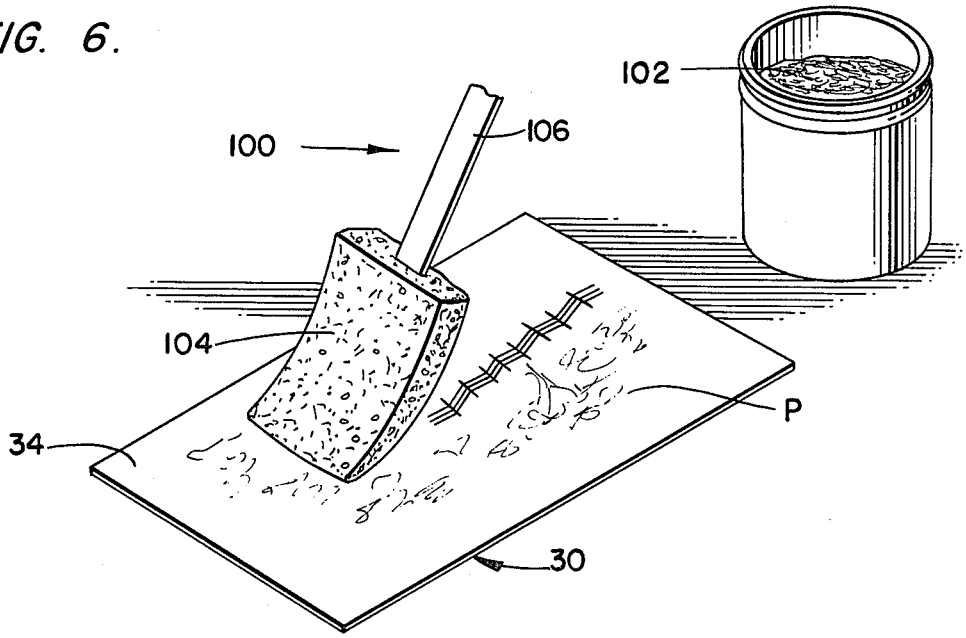
FIG. 6 is a perspective view of another step in carrying out the process embodying the teachings of the present invention.

A background is prepared for a picture P partially shown in FIGS. 5 and 6, using the steps indicated in FIGS. 1 and 2. A warming element 10, such as a food warming tray, or the like, is shown in FIG. 1. The element 10 has a planar upper surface 12 and preferably includes a temperature control 14 and is electrical, with a cord 16 connecting the heat producing means located beneath the planar surface 12 to a power source. The planar surface 12 is maintained at a temperature at which wax markers, such as crayons 20, will melt into a fluent mass 22, and remain liquid, but will not boil or otherwise break up. The fluent mass 22 remains viscous enough to be readily spread. Preferably, the wax will not be hot enough to bubble, but not be so cool as to smear when applied to a backing member such as a piece of paper 30 in the step described hereinafter. The paper can be white or colored as desired. Those skilled in the art will be able to select the temperature for surface 12 at which the crayon forms a liquid mass having a suitable and desirable viscosity. The mass 22 is formed by touching the hot surface 12 with a crayon tip or edge, with the tip being used in FIG. 1. Preferably, there should be just enough material in mass 22 to just cover one side of paper 30. The mass 22 can also be formed using several crayons to blend colors, or to produce streaks, or to produce highlights, or the like, as will occur to those skilled in the art. Masses can also be juxtaposed on the warming element to produce other effects.

The piece of paper 30 is then held at or adjacent one edge 32 thereof and smoothly and gently drawn through the mass 22 so that the crayon in mass 22 is transferred to face 34 of the paper. Preferably, the paper is drawn through the molten wax in one sweeping motion. The paper is moved through the mass 22 in a manner to produce a smooth and even background on the paper 30. It is noted that a blotchy background can be redone by rewaxing if done before the paper cools.

Other movements, such as rotary movements, spiral movements, or the like, can be used or combined with each other and/or with the above-discussed drawing movement to produce other effects, if so desired.

Preferably, the paper is a vintage gloss text paper having a glossy finish on face 34. The glossy finish of such paper prevents the paper from absorbing significant amounts of wax. Other similar papers can also be used without departing from the scope of this disclosure.

The background dries quickly, and appears as a smooth, even application of a layer of crayon to the paper 30.

Figure 3:
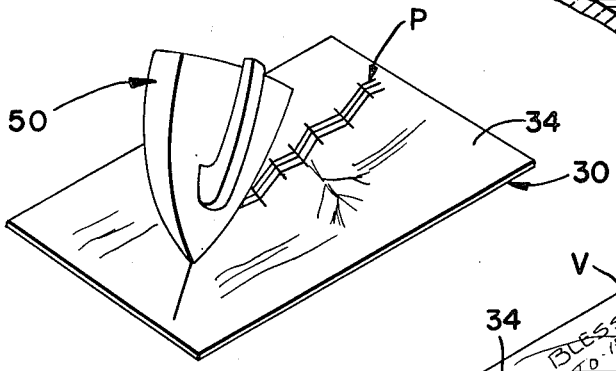
FIG. 3 is a perspective view showing another step in carrying out the process embodying the teachings of the present invention.

A picture, design, or the like, is then placed on the paper. This step is shown in FIG. 3 wherein a picture P is produced.

A hand-held tool is used to produce the picture. A preferred hand-held tool is a travel iron 50 as shown in FIG. 3. Such a tool is really three tools in one, as will appear from the ensuing discussion, but other tools such as woodburning irons, heated needles, or the like can be used without departing from the scope of the present invention.

Figure 7:
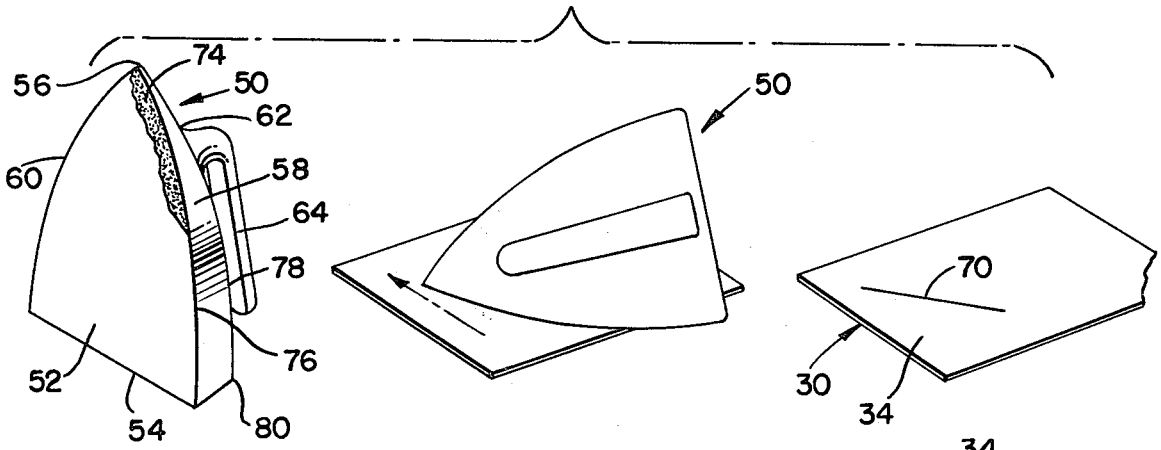
FIG. 7 is a perspective view showing movements of a hand-held tool required to define pattern elements in the process embodying the teachings of the present invention.

The travel iron 50 and the use thereof is best shown in FIG. 7, and attention is directed thereto. The iron 50 includes a planar bottom 52, a stern edge 54, a stem tip 56, a port side 58, a starboard side 60 and a top 62. A handgrip 64 is mounted on top 62. The iron 50 also contains heating elements (not shown), a power cord (not shown), as well as temperature regulating means (not shown). The iron 50 is maintained at a temperature sufficient to melt the wax material being used to form the picture. Considerations involved in temperature selection for the iron 50 are similar to those discussed above with regard to the warming element 10.

The tip 56 can be used to define lines 70 in the background by moving that tip over the background. The edges of the iron can also be used to define such lines. The wax of the background melts, thereby exposing some or all of the paper beneath the background. Varying amounts of pressure and/or angle between the iron and the paper can be used to define lines of various, and varying, widths, shapes, and the like.

Crayons can be melted onto the iron 50, either on the bottom 52, or on the tip 56, or on the sides 58 and/or 60, or even on the stem 54. A mass 74 of melted crayon is shown in FIG. 7. The melted wax is blotted onto and over the background to define leaves, grass, or the like. By varying the amounts of crayon in the mass 74, various effects can be produced. One or a plurality of colors can be used in the mass 74 to produce different effects.

Wax on the tip 56, as well as on edge 76, can be used to define colored lines. Varying pressure on the iron, or varying amounts of wax, or the like, can be used to vary the thickness of the lines thus defined. Wax on the tip or on the planar surface 52 can be blotted onto the background to define flowers, trees, or the like. Wax can be removed from the background using the tip as well.

The planar bottom adjacent the tip or the edges or the stem of the iron 50 can be stroked across the paper to produce a water effect. It is noted that the edges 78 and the tips 80 can also be used in carrying out the process. The strokes can be short, long, in any direction on the paper, even, varied, curved, or the like, as desired by the artist to produce sought effects.

It is also noted that while crayons have been specified, other means can also be used. A very acceptable media is produced by substituting TALLENS® for crayons. Even clear wax candles can be used. Other media will occur to those skilled in the art based on this disclosure, and will not be discussed; however, it is to be understood that such other media are also included in this invention.

Figure 4:
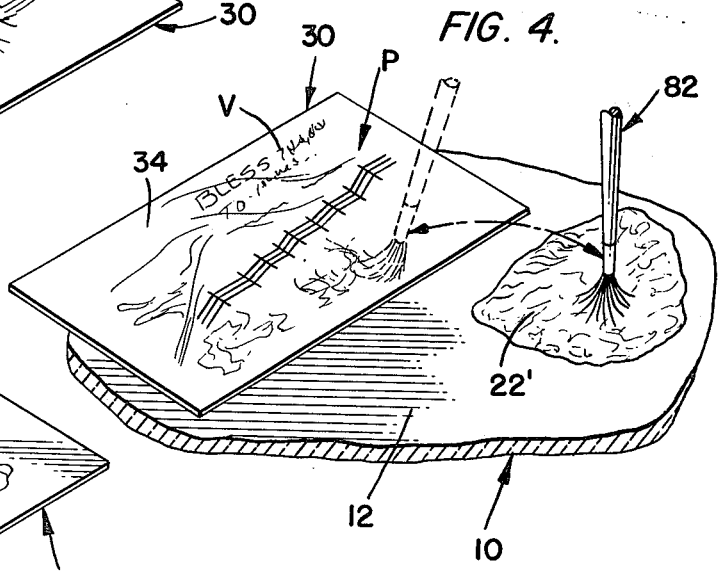
FIG. 4 is a view showing another step in carrying out the process embodying the teachings of the present invention.

A paintbrush 82 can also be used to complete the picture. A mass 22' of crayon is formed on the warming element, the brush dipped into that mass, and the molten crayon daubed, or otherwise applied to the picture as shown in FIG. 4. As also shown in FIG. 4, printed matter V can be included. The printed matter can be done free hand or in calligraphy. The process is as above-described, with the addition of Black Ink and Speed Ball calligraphy pens. The printed material is written before the art process begins.

A buffing step is shown in FIG. 5. After the wax on the paper is dry, a polishing cloth 90 is gently rubbed over the picture. The paper 30 is held against bending during this step. A facial tissue is suitable for use as polishing cloth 90. The buffing is carried out gently enough so the wax is not chipped.

A protective coating is applied to the buffed painting as shown in FIG. 6. The paper 30 is placed on a flat surface, and an applicator 100 is used to apply a protective coat, such as clear varnish 102 or the like, to the painting. The applicator preferably includes a spatula end 104 and a handle 106, with the spatula end being a soft material such as sponge rubber or the like. The varnish is brushed over the painting thinly and evenly with one or two strokes.

The painting is then set aside to dry.

Figure 8A:
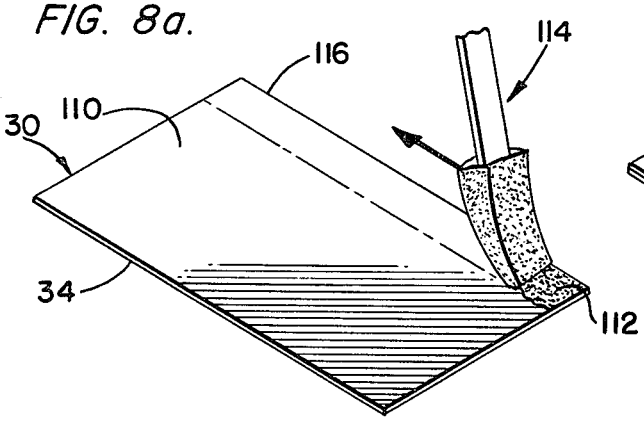
FIG. 8*a* is a perspective view showing another step in carrying out the process embodying the teachings of the present invention.

The paper can then be inverted so the painting is face down, and adhesive, such as glue 112, or the like, applied to the rear surface 110 by an applicator 114, which may be similar to applicator 100, as shown in FIG. 8*a*. The adhesive is preferably placed on the back surface adjacent a top edge 116 of the paper 30.

Figure 8B:
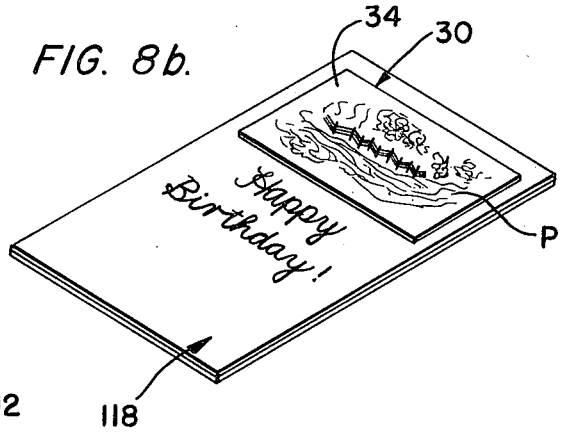
FIG. 8*b* is a perspective view showing another step in carrying out the process embodying the teachings of the present invention.

The paper is then suitably placed on a mounting member, such as centering the paper on a greeting card material 118 as shown in FIG. 8*b*, or the like. The paper is then pressed onto the mounting member, and set aside to allow the adhesive to dry.

The finished product is an original work of art which is quickly and easily produced. Each picture will be slightly different from all other pictures, and thus each picture will be unique regardless of the skill of the artist.

It is also noted that the glossy side of a card can be used to form large prints. Such side is a chrome-coated enamel. For weight, such is known as "10 point". Such heavy paper prevents wrinkling.

Figure 9:
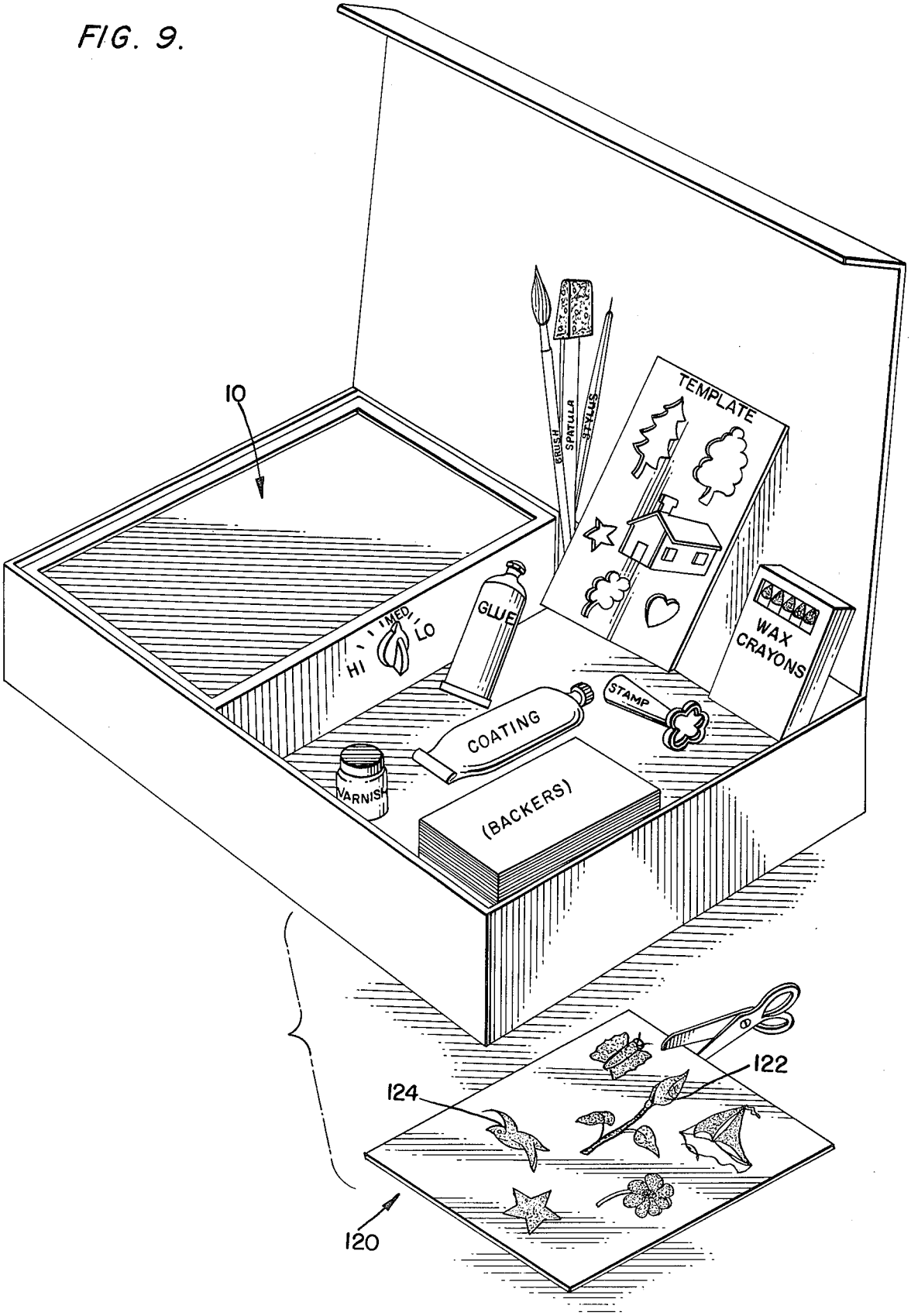
FIG. 9 is a perspective view showing a kit used in carrying out the process embodying the teachings of the present invention.

A kit can include all of the materials necessary to produce pictures using the above-discussed process. A kit is shown in FIG. 9, and can include templates, stencils, forms, stamps, tracing means, brushes and crayons. The kit can also include heating elements as well as hand-held tools. The kits can also include backing members, greeting card materials, adhesive, and the like. The completeness of the kit need only be controlled by the price, and other considerations of a manufacturer. The kit can also include the protective coatings as well as applicators, and the like. The templates, stencils and the like are used as guides and the hand-held tool is guided thereby to define forms and pictures produced by the above-disclosed method. Thus, for example, a template can have shapes for trees, flowers, people, houses, or the like, and a user need only place the appropriate form over a background formed as above-discussed, and use the hand-held tool with that template to define the desired shape. The stamps can be used to stamp out selected patterns, and can be heated or heatable as desired, and can be used while the background is still molten to define shapes therein. Wax can also be placed on the stamps and then transferred to the background.

Such a kit can contain a large variety of forms, colors, and the like. Those skilled in the art will be able to envision such kits from the present discussion, and accordingly, greater detail will not be presented. However, such lack of detail is not intended to be limiting.

Such a kit can also include wax cutouts such as indicated by reference numeral 120 in FIG. 9. Each cutout is an add-on figure such as flower 122, bird 124, and the like, to be positioned on the backing paper after the background is defined, and is formed of crayon, or the like, and is cut out using scissors, knives, or the like, then placed on the background. Alternatively, adhesive can be used to attach the cut out figure to the background.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A method of preparing a work of art comprising steps of:

providing a plurality of colored wax markers;

warming a planar element to a temperature at which said colored wax markers melt into a fluent mass upon contact with said planar surface, said predetermined temperature being below a temperature at which melted wax from such wax markers will break up;

contacting said warmed planar element with one of said colored wax markers and forming a first viscous mass of colored wax on said heated planar element;

holding a planar flexible backing member by an edge of such backing member;

drawing one surface of such backing member through said first mass of colored wax in one sweeping motion to form a smooth, even background coating of colored wax on said one surface;

allowing the colored wax to dry on the backing member;

providing a hand held tool which has a tip, at least one edge and a planar surface;

heating the tip, edge and planar surface of said hand held tool to said predetermined temperature;

drawing the heated tip through the dried colored wax on the backing member to melt portions of said dried wax and define a design in said background;

forming additional viscous masses of colored wax on said edge and on said planar surface of said heated hand held tool, said additional masses having colors different from said first mass and from each other;

touching the dried colored wax on the background with the additional masses on the heated tool edge and planar surface and transferring the additional masses of colored wax to that dried colored wax on the backing member;

allowing the additional colored wax to dry; and buffing the dried colored waxes by gently rubbing a polishing cloth over the dried colored waxes.

2. The method defined in claim 1 wherein said polishing step includes brushing a facial tissue over the design.

3. The method defined in claim 1 further including a step of applying a protective coating to the design.

4. The method defined in claim 3 wherein the protective coating includes varnish.

5. The method defined in claim 1 wherein the colored wax is supplied by a crayon.

6. The method defined in claim 1 wherein the backing member is a piece of paper.

7. The method defined in claim 1 wherein the hand-held tool is a travel iron.

8. The method defined in claim 1 further including steps of forming further viscous masses of colored wax on said planar element, said further masses having colors different from said first mass and from said additional masses and from each other, and transferring such further colored masses to the dried colored wax on the backing member with a brush.

9. The method defined in claim 1 further including a step of placing adhesive on the surface of the backing member which is opposite said one surface.

10. The method defined in claim 9 further including adhesively securing the backing member onto a mounting member.

11. The method defined in claim 1 wherein a template is used to guide said hand held tool to form the design.

12. The method defined in claim 1, further including a step of placing written material onto the backing member prior to forming said background coating.

* * * * *